US006257123B1

(12) United States Patent
Morr et al.

(10) Patent No.: US 6,257,123 B1
(45) Date of Patent: Jul. 10, 2001

(54) RODLESS SLIDES

(75) Inventors: Glen A. Morr, Churubusco; Michael E. Lamle, Syracuse, both of IN (US)

(73) Assignee: PHD, Inc., Fort Wayne, IN (US)

( * ) Notice: Subject to any disclaimer, the term of this patent is extended or adjusted under 35 U.S.C. 154(b) by 0 days.

(21) Appl. No.: 09/309,139

(22) Filed: May 10, 1999

Related U.S. Application Data

(63) Continuation-in-part of application No. 08/957,061, filed on Oct. 24, 1997.

(51) Int. Cl.[7] ..... F01B 29/00

(52) U.S. Cl. ..... 92/88; 92/140

(58) Field of Search ..... 92/88, 140, 247

(56) References Cited

U.S. PATENT DOCUMENTS

| | | | |
|---|---|---|---|
| Re. 33,637 | 7/1991 | Hoglund . | |
| Re. 34,049 | 9/1992 | Taki et al. . | |
| 1,379,041 | 5/1921 | Pulliam . | |
| 1,469,087 | 9/1923 | Hewitt . | |
| 2,109,128 | 2/1938 | Carrillo . | |
| 2,200,427 | 5/1940 | Merz . | |
| 2,410,405 | 11/1946 | Cornelius . | |
| 2,502,487 | 4/1950 | Scholl . | |
| 2,686,497 | 8/1954 | Dooley . | |
| 3,023,739 | 3/1962 | Dickson, Jr. et al. . | |
| 3,128,468 | 4/1964 | Bade . | |
| 3,199,289 | 8/1965 | Ramsay et al. . | |
| 3,205,787 | 9/1965 | Volkmann . | |
| 3,221,610 | * 12/1965 | King et al. | 92/88 |
| 3,421,718 | 1/1969 | Gehringer et al. . | |
| 3,893,378 | 7/1975 | Hewitt | 92/88 |
| 4,137,827 | 2/1979 | Hewitt | 92/88 |
| 4,373,427 | 2/1983 | Garlapaty . | |
| 4,419,924 | * 12/1983 | Peter et al. | 92/88 |
| 4,519,297 | 5/1985 | Lipinski . | |
| 4,545,290 | 10/1985 | Lieberman . | |
| 4,555,980 | 12/1985 | Hoglund . | |
| 4,664,020 | 5/1987 | Kaiser . | |
| 4,685,383 | 8/1987 | Ruchser . | |
| 4,724,744 | 2/1988 | Rosengren . | |
| 4,733,604 | 3/1988 | Lipinski . | |
| 4,819,546 | 4/1989 | Ernst et al. . | |
| 4,829,881 | 5/1989 | Taki et al. . | |
| 4,852,465 | 8/1989 | Rosengren . | |
| 4,856,415 | 8/1989 | Noda . | |
| 4,881,454 | 11/1989 | Granbom . | |
| 4,891,908 | 1/1990 | Aquilina . | |
| 4,960,037 | 10/1990 | Granbom . | |
| 4,991,494 | 2/1991 | Migliori . | |
| 4,998,459 | 3/1991 | Blatt . | |
| 5,111,913 | 5/1992 | Granbom . | |

(List continued on next page.)

FOREIGN PATENT DOCUMENTS

| | | |
|---|---|---|
| 44 13 512 | 10/1995 | (DE) . |
| 0 068 088 | 1/1983 | (EP) . |
| 0 147 803 | 7/1985 | (EP) . |
| 2 002 088 | 2/1979 | (GB) . |
| 2 163 499 | 2/1986 | (GB) . |

*Primary Examiner*—Edward K. Look
*Assistant Examiner*—Thomas E. Lazo
(74) *Attorney, Agent, or Firm*—Barnes & Thornburg

(57) ABSTRACT

Internal bearing assemblies for a rodless slide assembly. The internal bearing assemblies are positioned in bearing slots which are provided in portions of a transmission bracket and include inner bearing members and outer bearing shell members. Force applied to the internal bearing members causes them to slide up inclined surfaces of the bearing slots. The inner bearing members press against the outer bearing shell members which in turn press against the inner surface of the rodless slide bore. As a result, a radially inward force is applied to the transmission bracket. This radially inward force is transmitted to a saddle and external bearing assembly. The internal bearing assemblies thus hold the saddle against the outer surface of the rodless slide.

21 Claims, 11 Drawing Sheets

U.S. PATENT DOCUMENTS

| | | |
|---|---|---|
| 5,138,935 | 8/1992 | Granbom . |
| 5,159,814 | 11/1992 | Jakobsson . |
| 5,207,145 | 5/1993 | Kemmer . |
| 5,224,413 | 7/1993 | Herner . |
| 5,241,897 | 9/1993 | Drittel . |
| 5,245,912 | 9/1993 | Müller et al. . |
| 5,275,088 | 1/1994 | Takada et al. . |
| 5,277,101 | 1/1994 | Matsuiki et al. . |
| 5,279,207 | 1/1994 | Takada et al. . |
| 5,303,638 | 4/1994 | Green . |
| 5,311,810 | 5/1994 | Takada et al. . |
| 5,317,957 | 6/1994 | Miyamoto . |
| 5,333,535 | 8/1994 | Miyamoto et al. . |
| 5,335,583 | 8/1994 | Kaneko et al. . |
| 5,353,690 | 10/1994 | Shin . |
| 5,467,685 | 11/1995 | Hubl . |
| 5,467,686 | 11/1995 | Lipinski . |
| 5,469,775 | 11/1995 | Stoll et al. . |
| 5,469,940 | 11/1995 | Yamamoto et al. . |
| 5,473,971 | 12/1995 | Takeuchi et al. . |
| 5,483,868 | 1/1996 | Green . |
| 5,531,151 | 7/1996 | Matsui . |
| 5,537,912 | 7/1996 | Miyamoto et al. . |
| 5,555,789 | 9/1996 | Rosengren et al. . |
| 5,606,903 | 3/1997 | Drittel . |
| 5,619,899 | 4/1997 | Asai et al. . |
| 6,007,247 * | 12/1999 | Rosengren et al. ..... 92/88 |

* cited by examiner

RODLESS SLIDES

RELATED APPLICATION

The present application is a continuation-in-part of U.S. patent application Ser. No. 08/957,061, filed Oct. 24, 1997, the complete disclosure of which is hereby expressly incorporated by reference.

TECHNICAL FIELD

The present invention relates to a rodless slide structure. More particularly, the present invention relates to rodless slide assemblies and improvements thereto.

BACKGROUND ART

A typical rodless cylinder assembly includes an elongate cylinder having an axially extending slot therein and a piston assembly which moves reciprocally within the elongated cylinder under fluid pressure. The assembly is "rodless" in that rather than including a piston rod which is joined to a piston, the piston assembly is coupled to a motion transmitting element which extends through the slot. The motion transmitting element is coupled externally to a carriage or saddle which reciprocates with the piston assembly and to which a workpiece support, tool, tool support, etc. can be mounted or secured.

The axially extending slot is sealed by means of a sealing strip or band which is pressed against the axially extending slot by internal fluid pressures. The sealing strip or band is pulled away from the axially extending slot at the center of the piston assembly whereat the motion transmitting element extends through the slot.

Because of the complexity of the components of rodless cylinder assemblies and particularly the interaction and cooperation of various component elements, there are many features of rodless cylinder assemblies which have been the focus of improvement over the years. Improvements for rodless cylinder assemblies have focused on such elements as the sealing strip or band structures, the carriage assemblies, carriage guide means, piston brake assemblies, etc.

Rodless slides are similar in structure to rodless cylinders in that they include elongated cylinders which contain motion transmitting elements that extend through slots in the elongate cylinders. In rodless slides, the motion transmitting elements are driven in a reciprocating manner by threaded drive rods which are typically driven by stepper motors or servo motors.

The present invention is directed to improvements to rodless cylinder and rodless slide assemblies which have not been proposed or considered here-to-date.

DISCLOSURE OF THE INVENTION

In addition to other features of the present invention which will become apparent as the description thereof proceeds, the present invention provides a rodless slide which includes:

- a cylinder having opposed ends and a longitudinal slot;
- a threaded drive member within the cylinder and extending between the opposed ends; and
- a drive assembly which comprises:
  - a transmission bracket having cylindrical portions located in the cylinder, the cylindrical portions including bearing slots formed therein which bearing slots include inclined surfaces; and
  - internal bearing members which are positioned on the inclined surfaces of the bearing slots so as to freely slide thereon.

The present invention also provides a linear actuator which includes:

- an elongate chamber housing having an axis, a slot formed in a first side thereof, an internal bore, and a threaded drive member which extends through the internal bore;
- a transmission bracket which is positioned partially in the internal bore of the elongate chamber and which includes a mounting bracket that extends through the slot and a collar which receives the threaded drive member, the collar including a bearing slot therein; and
- internal bearing members which are positioned in the bearing slot for exerting a radial force on the mounting bracket.

The present invention further provides a method of coupling a saddle to a linear actuator assembly which involves:

- providing a linear actuator assembly which includes:
  - an elongate chamber housing having an axis, a longitudinal slot formed in a first side thereof, an internal bore, and a threaded drive member which extends through the internal bore; and
  - a transmission bracket which is positioned partially in the internal bore of the elongate chamber and which includes a mounting bracket that extends through the slot, and a collar which receives the threaded drive member, the collar including a bearing slot therein;
- positioning an internal bearing member assembly in the bearing slot;
- operably coupling the internal bearing member to the transmission bracket so that radial forces are exerted on the mounting bracket when the internal bearing member moves axially with respect to the transmission bracket; and
- coupling a saddle to the mounting bracket.

The present invention further provides an external bearing assembly for a linear actuator which includes:

- a body portion having opposed side walls for straddling a linear actuator; and
- a gib system provided in at least one of the opposed side walls,
- the gib system including a pair of tapered gib elements which are biased to move apart from one another.

BRIEF DESCRIPTION OF DRAWINGS

Features and characteristics of the present invention will be described hereafter with reference to the attached drawings which are given as non-limiting examples, in which.

BEST MODE FOR CARRYING OUT THE INVENTION

Figure 1:
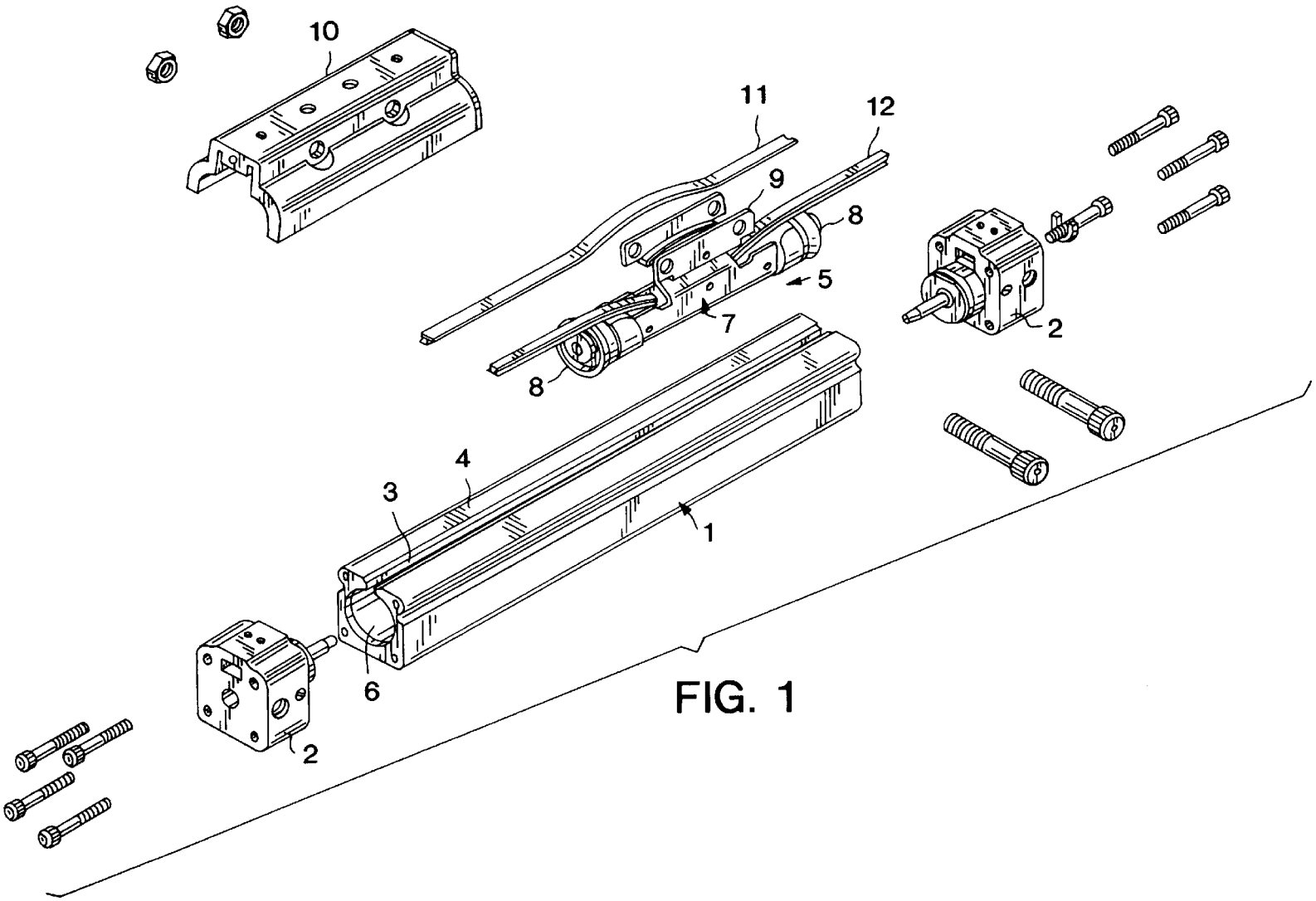
FIG. 1 is an exploded perspective view of a conventional rodless cylinder assembly which depicts the basic elements of a rodless cylinder.

The present invention is directed to rodless cylinder assemblies which have numerous features. According to one embodiment, the rodless cylinders of the present invention include internal bearing members which apply a downward or radially inward force to a transmission bracket and saddle coupled thereto. This downward or radially inward force is used to maintain the radial position of the saddle or carriage and an external bearing assembly which are attached to the transmission bracket. The internal bearing members eliminate the need for the type of external structural elements which are sometimes used to maintain the radial position of saddles or carriages.

The internal bearing members of the present invention can be used in conjunction with a bearing assembly that is provided with side bearing surfaces, and thereby used to resist the tendency of the slot to widen due to the fluid pressure within the cylinder.

The manner in which the piston elements are coupled to the transmission bracket allows the piston elements to "float" within the cylinder bore. That is, the piston elements are movably coupled to the transmission bracket so that they are allowed to self-adjust into alignment with the internal bore of the piston cylinder. The piston elements are coupled to the transmission bracket in such a manner that they are allowed to move radially or "float" with respect to the central axis of the cylindrical bore of the piston assembly, but are restricted from longitudinal movement.

The manner in which the piston elements are coupled to the transmission bracket so that they "float" was developed to be used in conjunction with the internal bearing members of the present invention. Nevertheless, the "floating" piston elements of the present invention can be used in conjunction with other rodless piston assemblies which do not use the internal bearings of the present invention. The "floating" piston elements would function to self-align with the bore in any rodless piston assembly.

The use of the internal bearing members of the present invention allows for automatic adjustment of the external bearing assembly due to the manner in which the internal bearing members cooperate with the transmission bracket and the inner surface of the cylindrical bore of the piston assembly. That is, as the lower surfaces of the bearing assembly wear, the internal bearing members merely "slide" further up inclined surfaces of the transmission bracket.

The present invention is further directed to rodless slide assemblies which are configured to include internal bearing assemblies which apply a downward or radially inward force to a transmission bracket and saddle coupled thereto. As in the case of the rodless cylinder assemblies, this downward or radially inward force is used to maintain the radial position of the saddle or carriage and an external bearing assembly which are attached to the transmission bracket. The internal bearing members eliminate the need for the type of external structural elements which are sometimes used to maintain the radial position of saddles or carriages.

The present invention is further directed to a gib system for an external bearing assembly or bearing shoe, which gib system provides for self-adjusting tightening of the external bearing assembly or bearing shoe against the elongate cylinder body of a rodless cylinder, rodless slide assembly or other linear actuator.

FIG. 1 is an exploded perspective view of a conventional rodless cylinder assembly which depicts the basic elements of a rodless cylinder. As depicted, the rodless cylinder assembly includes an elongate cylinder assembly 1 having end members 2, a slot 3 formed in one elongate surface 4 thereof, and a piston assembly 5 which is positioned within a cylindrical bore 6 of the elongate cylinder assembly 1. The piston assembly 5 includes a piston bracket 7 having piston end portions 8 and a structure 9 which can extend through slot 3 and connect to a saddle assembly 10. The rodless piston assembly of FIG. 1 also includes upper and lower sealing members 11 and 12 which respectively seal slot 3 externally and internally.

Figure 2:
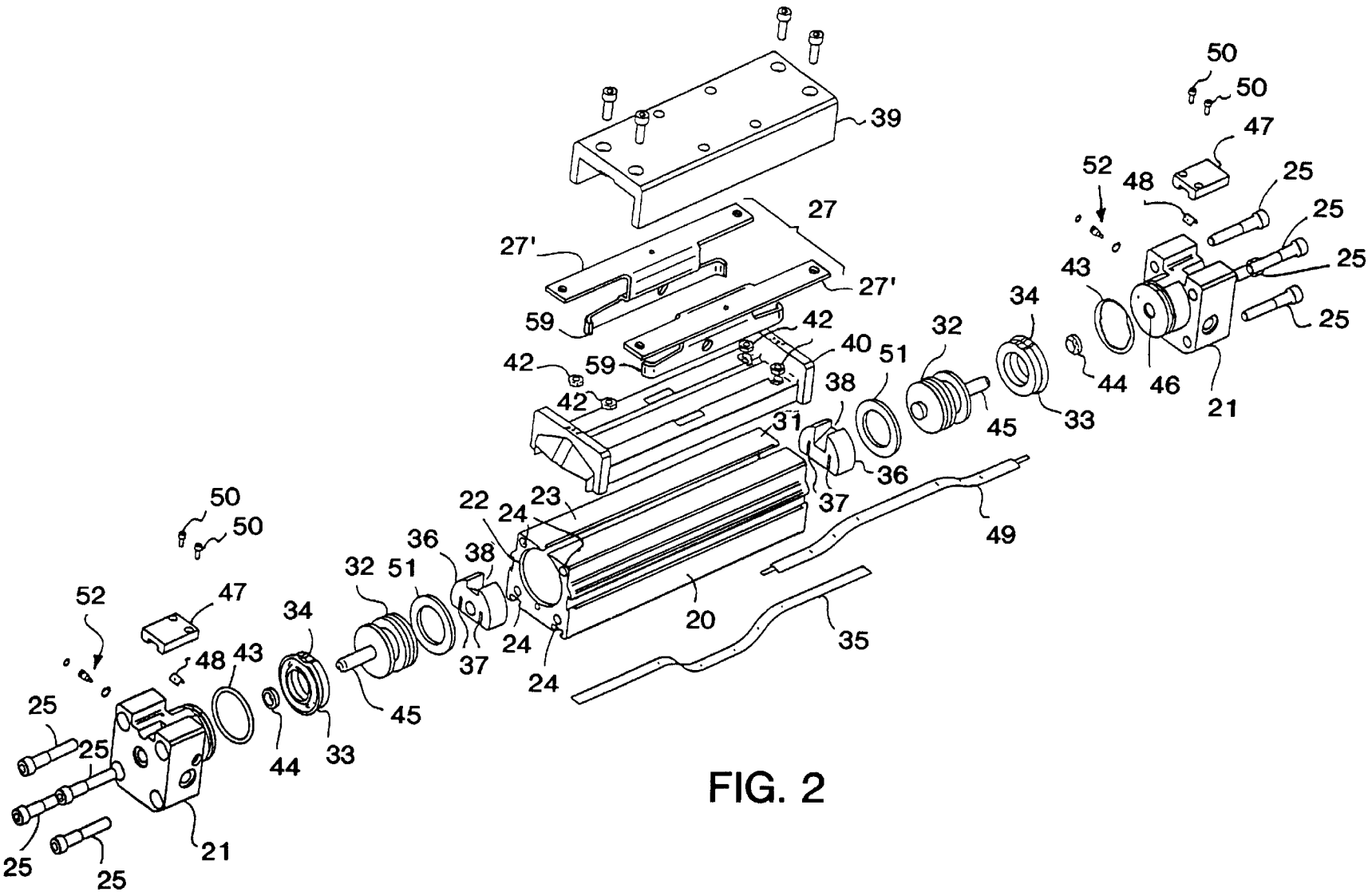
FIG. 2 is an exploded perspective view of a rodless cylinder assembly according to one embodiment of the present invention.

FIG. 2 is an exploded perspective view of a rodless cylinder assembly according to one embodiment of the present invention. The rodless cylinder assembly includes a cylinder assembly which comprises an elongate cylinder body 20 and end cap or head assemblies 21 which seal the elongate cylinder body 20 at opposite ends. The elongate cylinder body 20 includes a cylindrical bore 22 and a slot 23 in one of the side walls which can extend along the length thereof. The ends of the elongate cylinder body 20 are provided with threaded bores 24 which receive threaded members, e.g. bolts 25 that are used to secure the head assemblies 21 to the elongate cylinder body 20.

Figure 3:
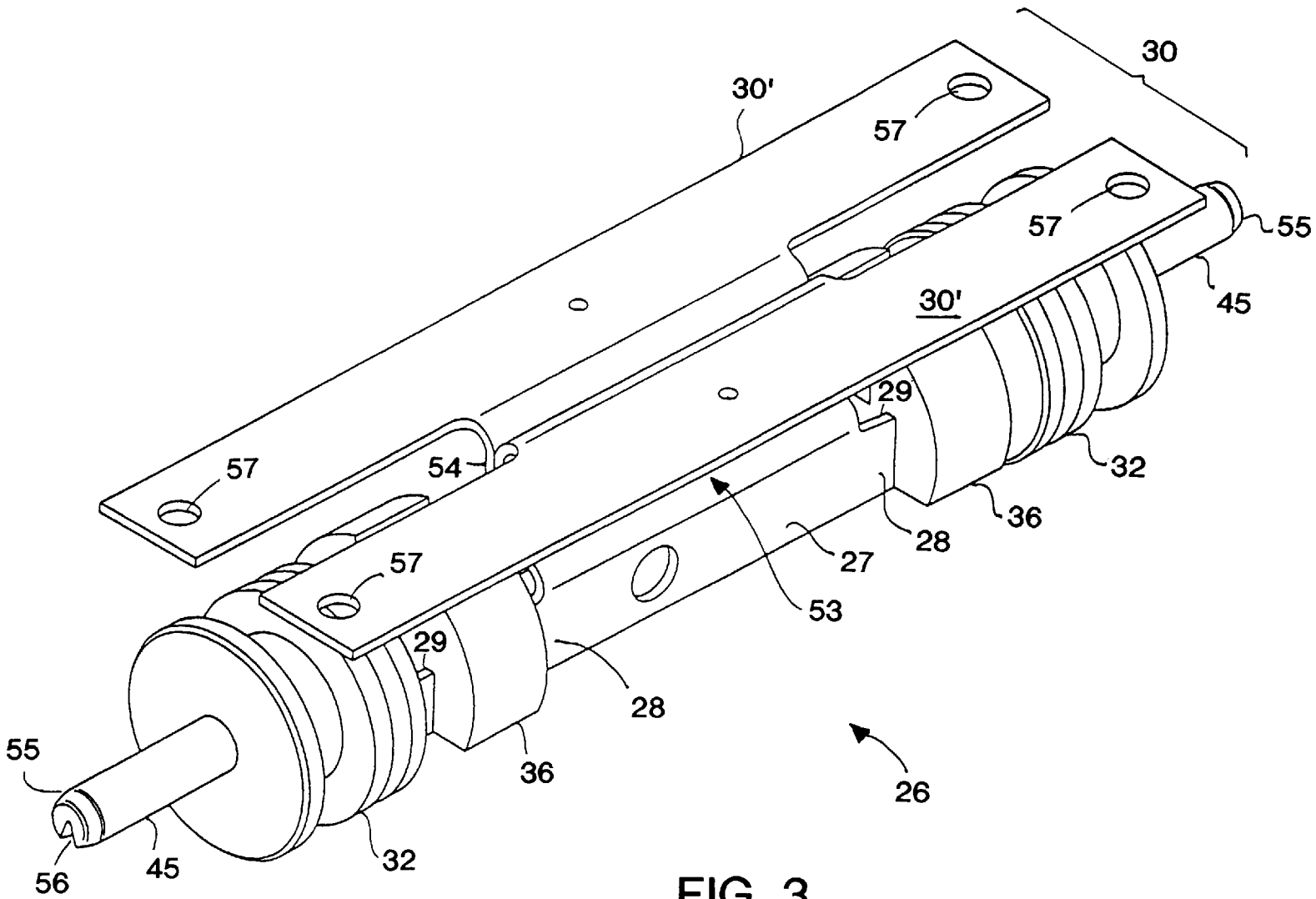
FIG. 3 is a perspective view of a piston assembly according to one embodiment of the present invention.

The rodless cylinder assembly includes a piston assembly (FIG. 3) which is positioned within cylindrical bore 22 and includes a structure which extends through slot 23. The piston assembly 26 includes a transmission bracket 27 which, as depicted in the embodiment of FIG. 2, is made from two portions 27' that can be attached together as depicted in FIG. 3. When the rodless piston assembly is assembled, the lower portion of the transmission bracket which defines the side members 28 and rails 29 as identified below resides within the cylindrical bore 22. The upper portion of the transmission bracket 27 which defines the mounting plate 30 as identified below is located adjacent the outer wall surface 31 of the elongate cylinder body 20 which surface 31 has the slot 23 formed therein. The central portion of the transmission bracket 27 defines a narrow portion which extends through slot 23.

The piston assembly includes piston elements 32 which are attached to the ends of the transmission bracket 27 as discussed below. Piston seal members 33 are provided which can be secured to the peripheral surface of the piston elements 32 in a conventional manner. The piston seal elements 33 depicted in FIG. 2 are provided with notched-out portions 34 which conform to the cross-sectional shape of lower or inner band member 35.

Internal bearing members 36 are positioned on the transmission bracket 27 behind the piston elements 32 as depicted. The internal bearing members 36 are provided with a pair of parallel lower slots 37 for receiving the rails 29 of the transmission bracket 27 as discussed below, and a centrally located inclined upper slot 38 which is provided to allow lower or inner band member 35 to slide therethrough.

FIG. 2 also depicts an external bearing assembly 39 and a saddle 40 which is designed to be secured to the upper portion or mounting plate 30 of the transmission bracket 27 and external bearing assembly 40 by threaded members, e.g. bolts 41 and nuts 42. Also shown in FIG. 2 are seal members, e.g., o-rings 43 which are used to seal the head assemblies 21 onto the ends of the elongate cylindrical body 20, and the snout seals 44 which provide a seal between piston cushion studs 45 and snouts 46 located in the head assemblies 21. In addition, FIG. 2 shows band clamp plate 47 and blocker 48 which are used to secure the ends of band members 35 and 49 in place. The band clamp plate 47 is secured in position by threaded members 50. FIG. 2 also includes oil wicks 51 which are positioned adjacent piston elements 32.

Outward motion of the piston elements 32 is arrested by having the piston cushion studs 45 enter the snouts 46 in the head assemblies 21. Fluid pressure trapped by the piston cushion studs 45 controls deceleration of the piston elements 32 and prevents bouncing of the piston elements 32. Valve elements 52 are provided in the head assemblies 21 and used to meter release of fluid pressure that is trapped in the snouts 46 by the piston cushion studs 45. According to one embodiment of the present invention, the piston cushion studs 45 are sufficiently tapered along a substantial portion of their length to control the release of fluid trapped in the snouts of the head assemblies.

FIG. 3 is a perspective view of a piston assembly according to one embodiment of the present invention. The piston assembly generally identified by reference numeral 26 includes transmission bracket 27 (shown with the two half portions 27' of FIG. 2 attached together), internal bearing members 36 and piston elements 32. The transmission bracket 27 as depicted in FIG. 3 includes a pair of parallel elongated side members 28 which define a pair of rails 29 upon which the internal bearing members 36 are received. In this regard, the lower pair of slots 37 in the internal bearing members 36 are configured so that the internal bearing members 36 can be seated in a sliding manner on the rails 29. That is, so that the rails 29 are received in the lower parallel slots 37 of the internal bearing members 36.

The transmission bracket 27 includes a mounting bracket 53 which extends in a radial direction with respect the longitudinal axis of the transmission bracket. The mounting bracket 53 includes a narrow portion 54 which is sized to be received in and extend through slot 23. The mounting bracket 53 includes a mounting plate 30 to which a saddle 39 can be coupled as discussed herein. The mounting plate 30 is defined by the two upper portions 30' of the transmission bracket 27 which are depicted in FIG. 2.

The piston elements 32 are depicted as being coupled to the ends of the transmission bracket 27. In the embodiment depicted, the piston elements 32 include piston cushion studs 45 which extend outwardly from the transmission bracket 27. These piston cushion studs 45 are depicted as having a beveled end 55 and a V-shaped notch 56 at the end. When the piston cushion stud 45 is driven into the snout 46 in its respective head assembly 21, the V-shaped notch 56 allows trapped fluid to escape at a controlled rate thereby slowing the piston element 32 to a stop. In an alternative embodiment, the piston cushion stud 45 could be provided with an elongated tapered portion in place of the beveled end 55, which elongated tapered portion would control the escape of trapped fluid and slow the piston element 32 to a stop.

The transmission bracket 27 can be fabricated from two metal half members or portions 27' by fastening the portions together at the mounting bracket 53 as depicted (or elsewhere). Alternatively, the transmission bracket 27 can be formed as an integral structure. The mounting plate 30 is depicted as having a rectangular upper surface with a plurality of mounting holes 57. From the following description, it is to be understood that the mounting plate 30 can have other configurations that will be compatible with other carriage and/or saddle designs.

Figure 4:
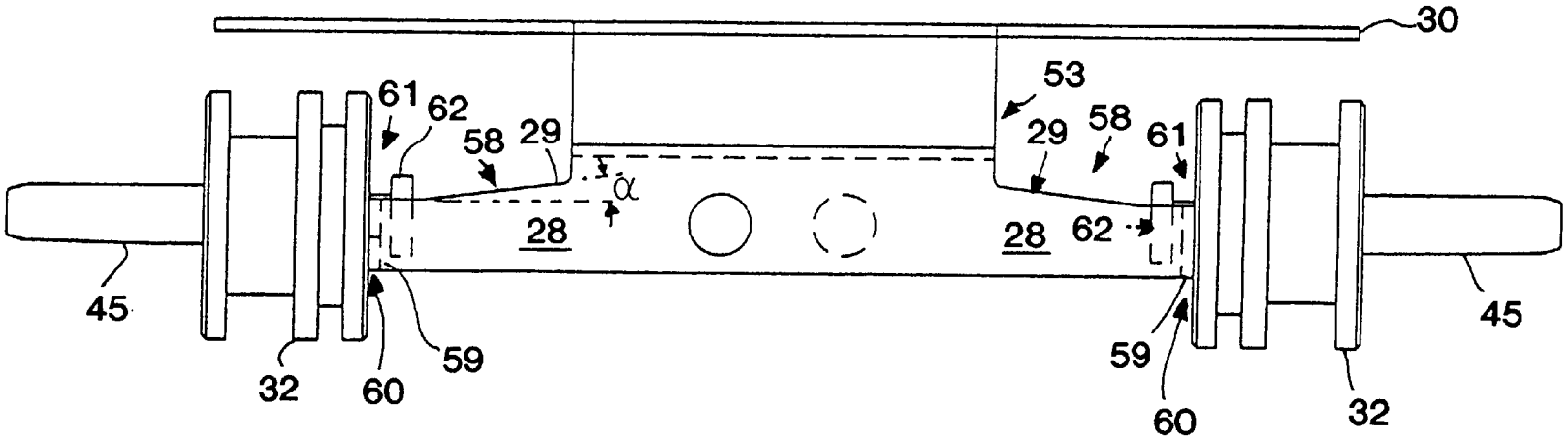
FIG. 4 is a side view of the transmission bracket of FIG. 3.

FIG. 4 is a side view of the transmission bracket of FIG. 3. The transmission bracket 27 in FIG. 4 does not have the internal bearing members 36 positioned on the rails 29 thereof. As depicted, the upper portions of the rails 29 include a slightly inclined or sloped portion 58 which slopes downward in the direction away from the center of the bracket.

The upper ends of the rails 29 are slightly inclined, e.g. approximately 3° to 6° as indicated by angle "$\alpha$" in FIG. 4. When the internal bearing members 32 are positioned on the inclined portions 58 of the rails 29, movement of the internal bearing members 36 inward toward the center of the transmission bracket 27 causes the internal bearing members 36 to slide upward along the inclined portions 58 of the rails 29. This upward movement of the internal bearing members 36, as discussed in detail below, causes the transmission bracket 27 to be forced downward. According to the present invention, this downward force applied to the transmission bracket 27 is transferred to a saddle 39 which is coupled to the transmission bracket 27 by the mounting plate 30.

Figure 5:
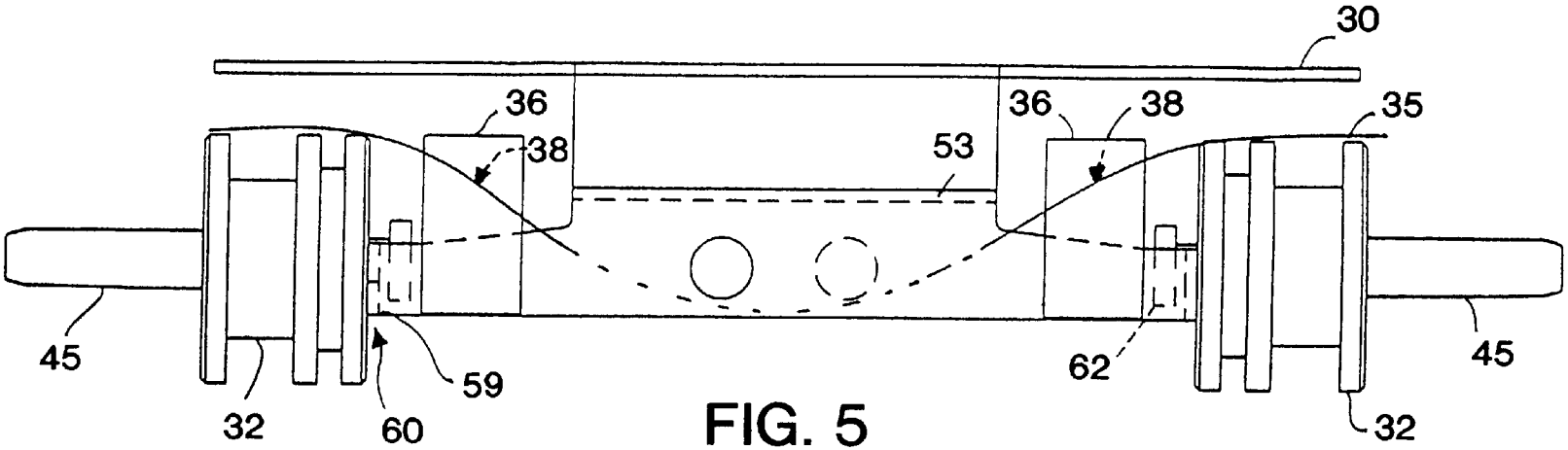
FIG. 5 is a side view of the transmission bracket of FIG. 4 which includes the internal bearings.

FIG. 5 is a side view of the transmission bracket of FIG. 4 which includes the internal bearing members. FIG. 5 depicts how upper inclined slots 38 in the internal bearing members 36 are aligned so that the inner band member 35 can slide through inclined slots 38 and beneath mounting bracket 53 and between parallel elongate side members 28. FIG. 5 further depicts how the base of the lower pair of parallel slots 37 of the internal bearing members 36 are inclined complementarily with the inclined portions 58 of the rails 29 so as to ensure that the internal bearing members 36 are aligned with the piston elements 32 and the inner surface of the cylindrical bore 22 of the elongate cylinder body 20.

Each of FIGS. 4 and 5 depict how the piston elements 32 are coupled to the transmission bracket 27 according to one embodiment of the present invention. As depicted in FIG. 2, the side members 28 of the transmission bracket 27 include inwardly directed end portions 59 which (when the transmission bracket 27 is assembled) define slots 60 which are located at each end of the transmission bracket 27 (See FIG. 2). The piston elements 32 each include a projection 61 that is configured to be received and retained in the slots 60 of the transmission bracket 27 as depicted. In addition, projections 61 include head portions 62 which serve to abut against a spring member 63 that is depicted in FIG. 6.

Figure 6:
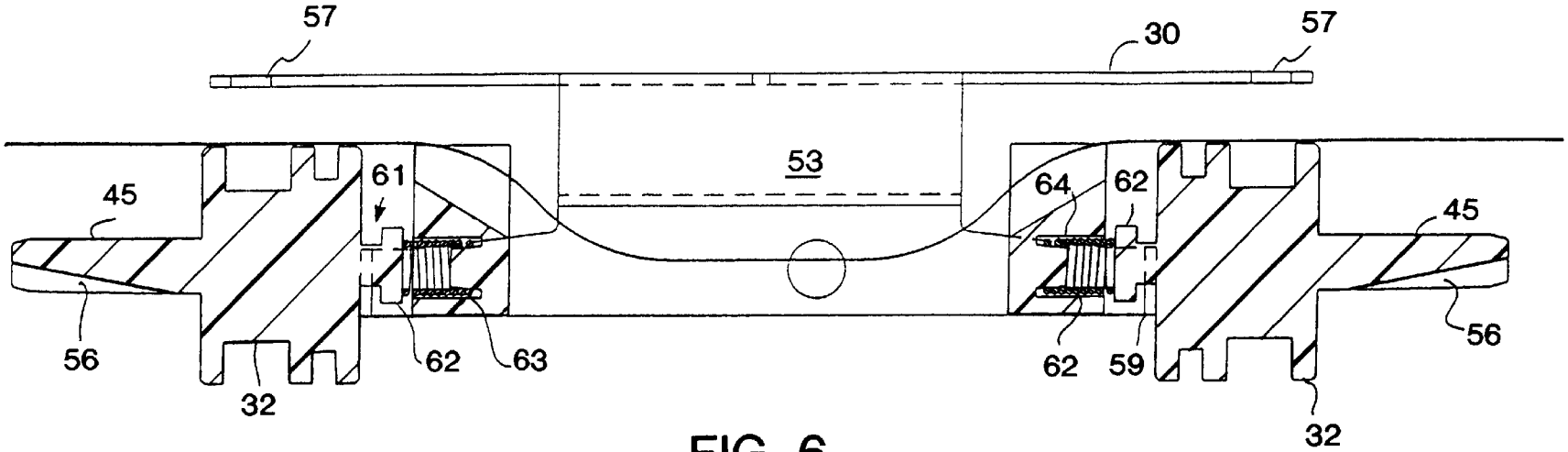
FIG. 6 is a cross-sectional view of a piston assembly which includes spring members that urge the internal bearing members toward the center of the transmission bracket.

FIG. 6 is a cross-sectional view of a piston assembly which includes spring members 63 that urge the internal bearing members 36 toward the center of the transmission bracket 27, and thus up along inclined portion 58 of the rails 29. The spring members 63 are depicted as be positioned between the head portions 62 of piston projections 61 and the bottom of a shallow bore formed in a face of the internal bearing members 36. These spring members 63 are provided to urge the internal bearing members 36 toward the center of the transmission bracket 27 so that they press against the upper inner surface of the cylindrical bore 22. It is noted that the spring members 63 are depicted as being depressed by the piston elements 32. In actual use, the spring members 63 would tend to push the piston elements 32 outward, absent any fluid pressure acting on the piston elements 32. The projections 61 also couple the piston elements 32 to the transmission bracket 27. Absent such coupling, it would be possible for the piston elements 32 to become separated and spaced apart from the transmission bracket 27. If fluid pressure was applied during such separation, it is possible for the piston elements 32 to slam into the transmission bracket 27 and become damaged.

It is noted that the manner in which the piston elements 32 are coupled to the transmission bracket 27 allows the piston elements 32 to "float" within the cylindrical bore 22. That is, the piston elements 32 are movably coupled to the transmission bracket 27 so that they are allowed to self-adjust into alignment with the cylindrical bore 22 of the piston elongate cylinder body 20. In this regard, it is noted that piston elements 32 are only coupled to the ends of the transmission bracket 27 in a manner which generally restrains their longitudinal axial movement with respect to the transmission bracket 27. The piston elements 32 are otherwise able to move with respect to the transmission bracket 27 so that their respective central axes can be aligned or displaced from one another.

Figure 7:
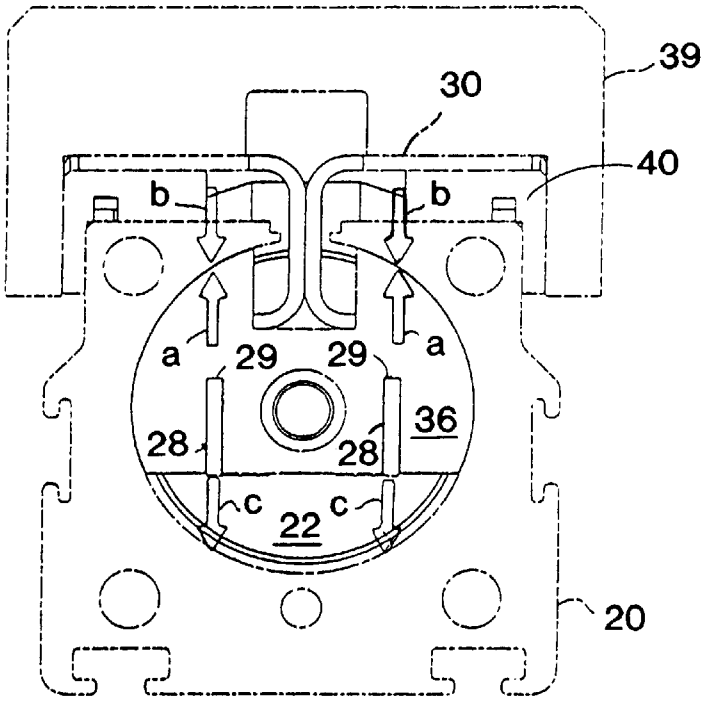
FIG. 7 is schematic axial cross-sectional view of a rodless cylinder assembly according to the present invention taken through one of the internal bearing members which depicts the forces acting on the elements.

FIG. 7 is schematic axial cross-sectional view of a rodless cylinder according to the present invention taken through one of the internal bearing members which depicts the forces acting on the elements. As each of the internal bearing members 36 slides along the rails 29 toward the center of the transmission bracket 27 (into the page in FIG. 7) it moves up the inclined portions 58 of the rails 29 and is pressed against the upper inner surface of the cylindrical bore 22. Forces exerted between the internal bearing member 36 and the inner surface of the elongate cylindrical body 20 as indicated by arrows "a" and "b" create a resultant force which pushes the transmission bracket 27 downward as indicated by arrow "c" in FIG. 7.

Figure 8:
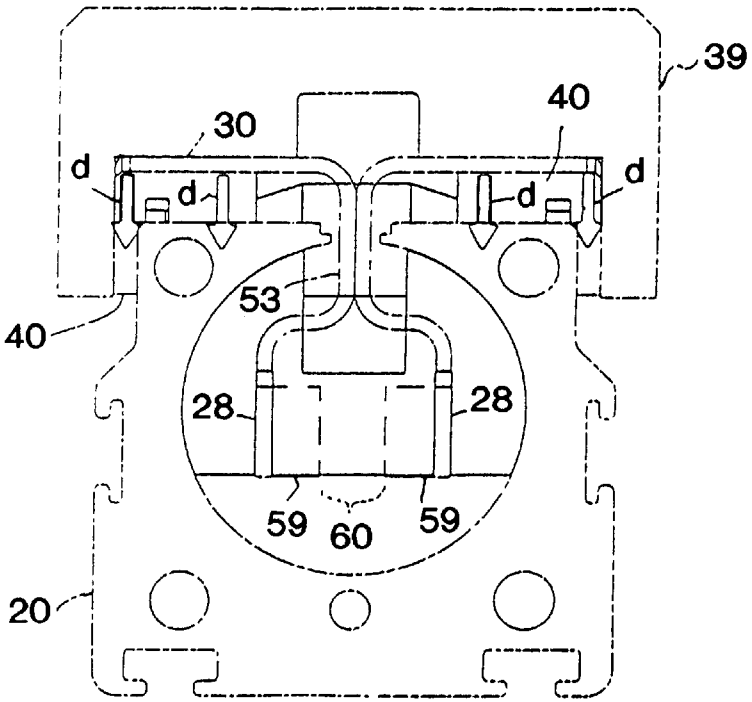
FIG. 8 is schematic axial cross-sectional view of a rodless cylinder assembly according to the present invention taken through the center of the transmission bracket which depicts the forces acting on the elements.

FIG. 8 is schematic axial cross-sectional view of a rodless cylinder assembly according to the present invention taken through the center of the transmission bracket which depicts the forces acting on the elements. The force represented by arrow "c" in FIG. 7 which acts upon the transmission bracket 27 when the internal bearing member 36 slides along the inclined portions of the rails and pushes against the inner surface of the cylindrical bore 22 is transmitted through the mounting bracket 53 and mounting plate 30. As indicated by arrows "d" in FIG. 8, the mounting plate 30 distributes the downward force to saddle 39 which applies the downward force to an external bearing assembly 40 which is provided between the upper surface 31 of the elongate cylinder body 20 and the saddle 39.

The downward force which essentially pulls saddle 39 downward against surface 31 of the elongate cylinder body 20 maintains the radial position and alignment of the saddle 39 with respect to the axis of the elongate cylinder body 20. Thus, the use of the internal bearing member 36 according to the present invention eliminates the need for external structural elements to secure the saddle 39 and elongate cylinder body 20 together. As depicted in FIG. 8, the saddle 39 and/or external bearing assembly 40 can include arm portions 65 which extend over sides 66 of the elongate cylindrical body 20 which are adjacent surface 31 thereof. These arm portions 65 can be provided to maintain the axial position and alignment of the saddle 39 (and external bearing assembly 40) with respect to the axis of the elongate cylinder body 20.

Figure 9:
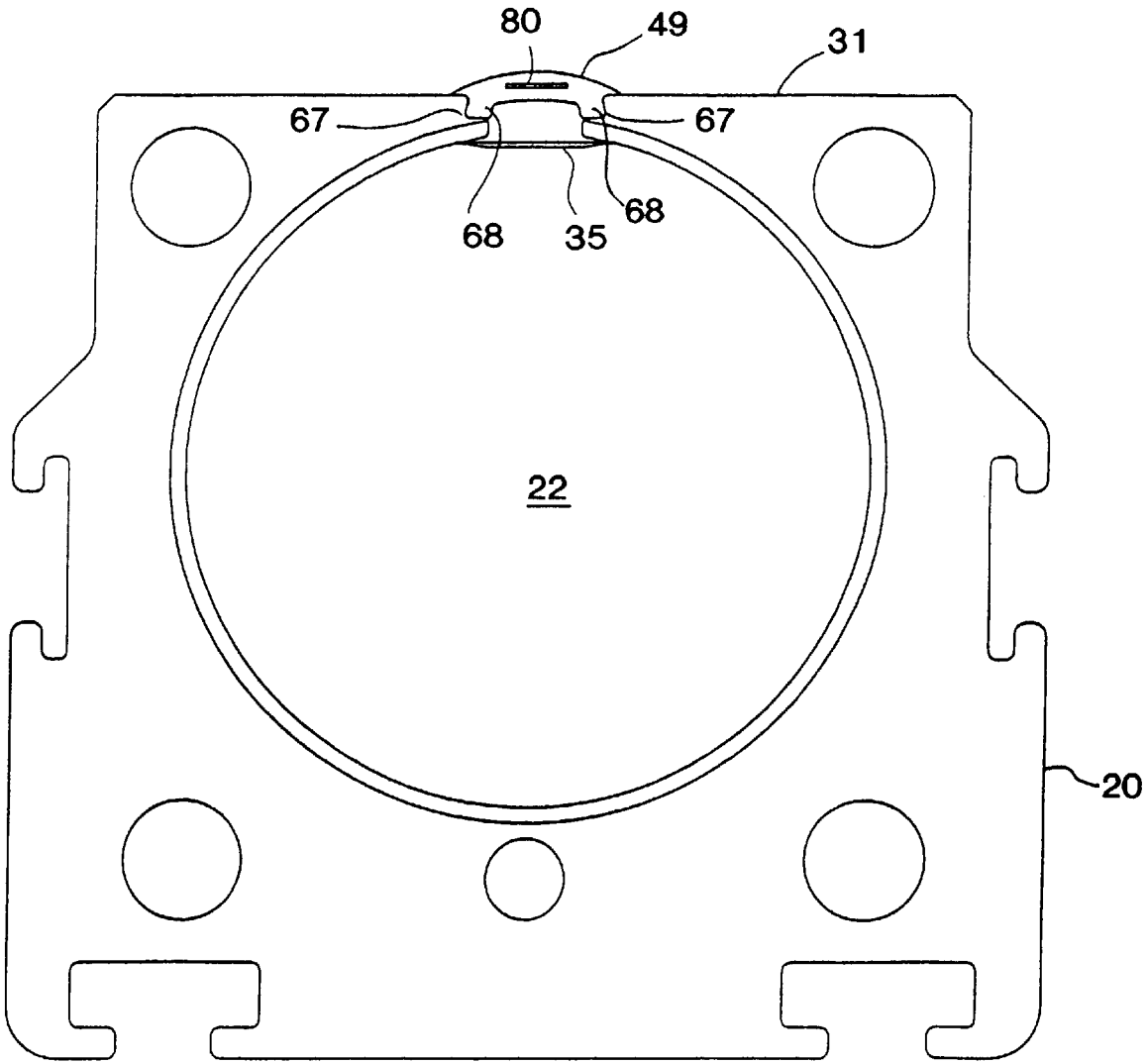
FIG. 9 is an axial cross-sectional view of an elongate cylindrical body and the outer and inner band members according to one embodiment of the present invention.

FIG. 9 is an axial cross-sectional view of the elongate cylindrical assembly and the inner and outer band members according to one embodiment of the present invention. As depicted, slot 23 is provided with undercut edge portions 67 along the length thereof where slot 23 intersects surface 31 of the elongate cylinder body 20. As shown in the cross-sectional view, the outer band member 49 is provided with leg portions 68 which are complementarily shaped with the undercut edge portions 67 of the slot 23 to the extent that the outer band member can be readily pulled or stripped out of slot 23 and pushed back into slot 23 as the piston assembly 26, external bearing assembly 40 and saddle 39 move in a reciprocal manner. The outer band member 49 includes an inner metal member 80 which extends along the length thereof. Metal member 80 assists in extruding the upper band member 49 and strengthens the upper band member 49 so that the leg portions 68 extend outward as depicted for being receivable in undercut edge portions 67.

The inner band member 35 is also depicted in a cross section in FIG. 9. The inner band member 35 has a substantially planar lower surface which interrupts the circular cross-sectional shape of cylindrical bore 22. As depicted in FIG. 2, the piston seals 33 are provided with a cutout or notched portion 34 which is complementarily shaped to cross-sectional shape of the cylindrical bore 22 as interrupted by the inner band member 35.

Figure 10:
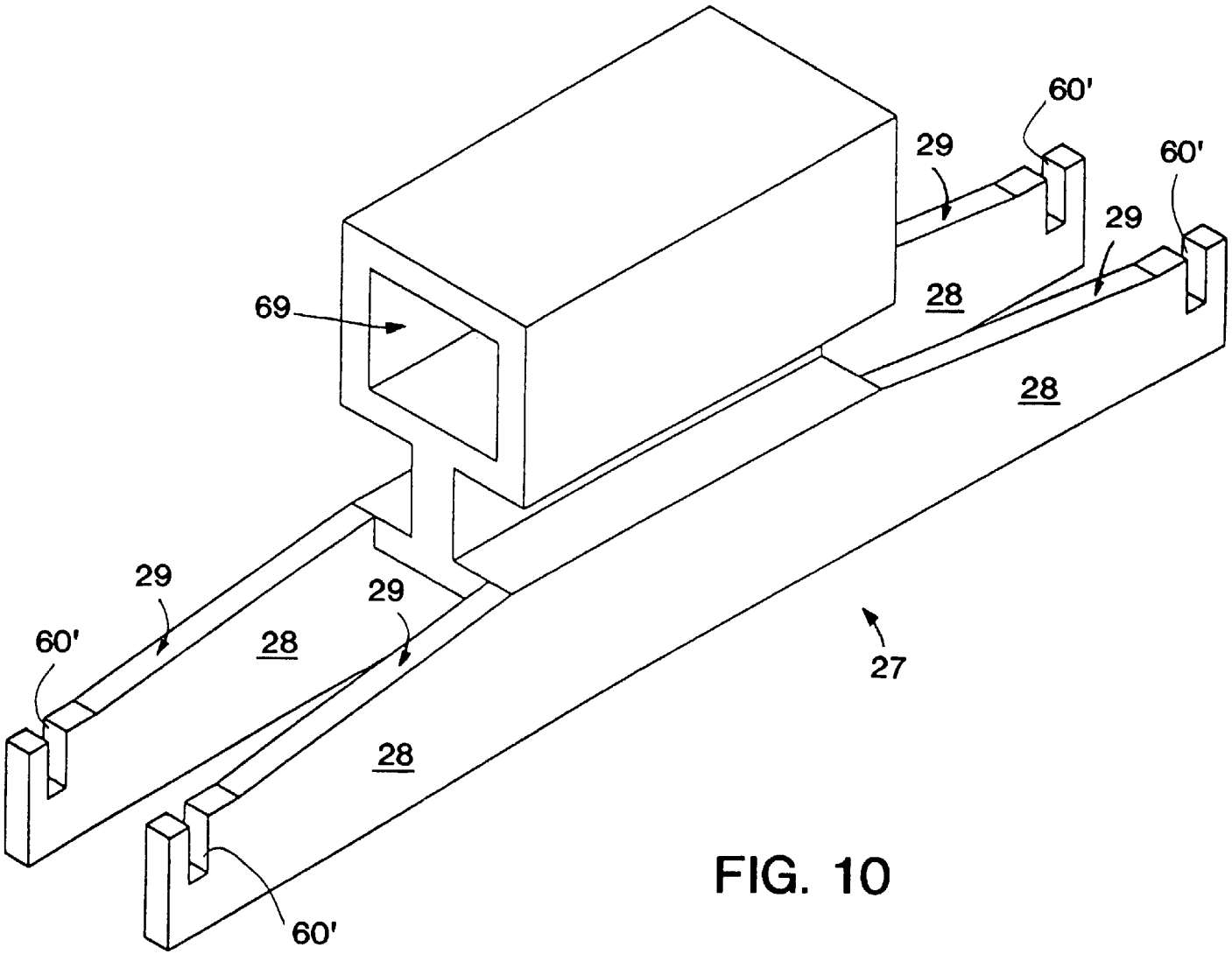
FIG. 10 is perspective view of the transmission bracket according to another embodiment of the present invention.

FIG. 10 is a perspective view of the transmission bracket according to another embodiment of the present invention. The transmission bracket 27 depicted in FIG. 10 includes open slots 60' which are formed in the side members 28 near the ends thereof. These open slots 60' are depicted as intersecting the rail 29 upon which the internal bearing members 36 slide. These open slots 60' are provided to couple the piston elements 32 to the piston transmission bracket 27. In this regard, the piston elements 32 can be provided with a projection similar to that depicted in FIG. 4 (projection 61) which is configured to be received and retained in the open slots 60' of the transmission bracket 27. It is to be understood that the ends of the side members 28 could include other structure for coupling the piston elements 32 to the transmission bracket 27.

The transmission bracket 27 depicted in FIG. 10 also includes structure which defines an upper channel 69 which is designed to allow the upper band member 49 to pass therethrough when the piston assembly 26 moves reciprocally along the elongate cylinder body 20.

Figure 11:
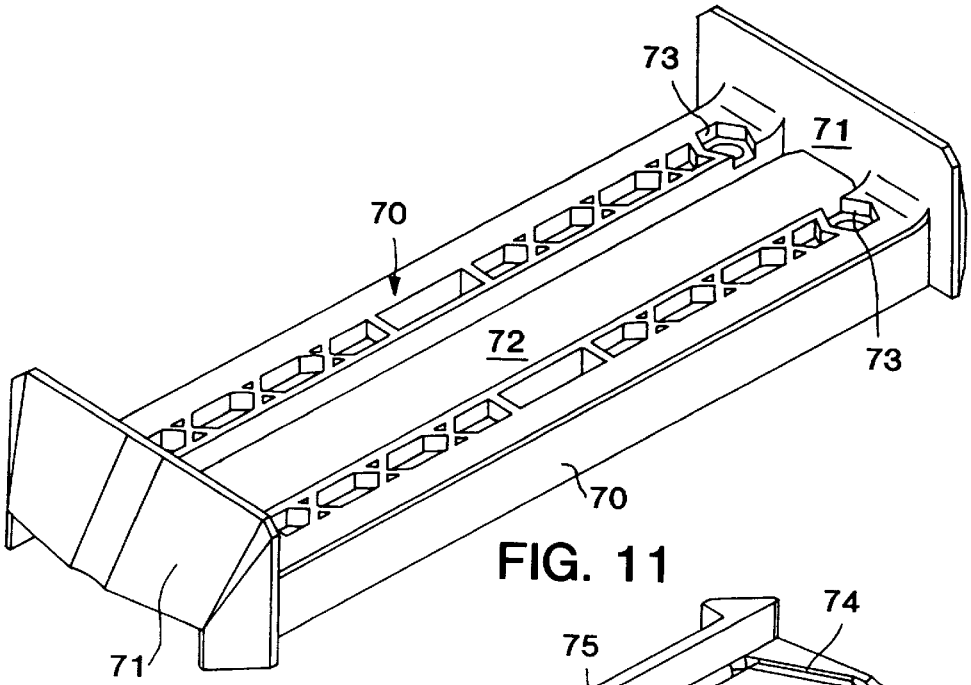
FIG. 11 is a perspective top view of the external bearing assembly according to one embodiment of the present invention.

FIG. 11 is a perspective view of the external bearing assembly according to one embodiment of the present invention. FIG. 11 depicts the external bearing assembly 40 in perspective from a top view point. The external bearing assembly 40 includes parallel side members 70 which define external bearing surfaces (see FIG. 13) and end portions 71 which couple the parallel side members 70 together. The external bearing assembly 40 includes an open central portion 72. As can be seen from FIG. 2, the open central portion 72 allows for assembly of the rodless cylinder. In this regard, the lower portion (parallel side members 28 and mounting bracket 53) of the transmission bracket 27 can be inserted through the opening in the open central portion 72 in the external bearing assembly 40 so that the mounting plate 30 rests on the upper surface of the parallel side members 28. As discussed above, the forces exerted on the internal bearings "pulls" the transmission bracket 27 (and external bearing assembly 40) radially inward toward the axial center of the rodless elongate cylinder body 20.

The saddle 39 (FIG. 2) can be coupled to the mounting plate 30 of the transmission bracket 27 by any convenient means. For example, in the embodiment of the external bearing assembly depicted in FIG. 11, counter-sunk bores 73 are provided in the upper surface of the parallel side members 28. These counter-sunk bores 73 are configured to receive internally threaded nuts 42 (FIG. 2). Threaded bolts 41 (FIG. 2) can be used together with threaded nuts 42 to couple the saddle 39 to the mounting plate 30 as depicted in FIG. 2.

Figure 12:
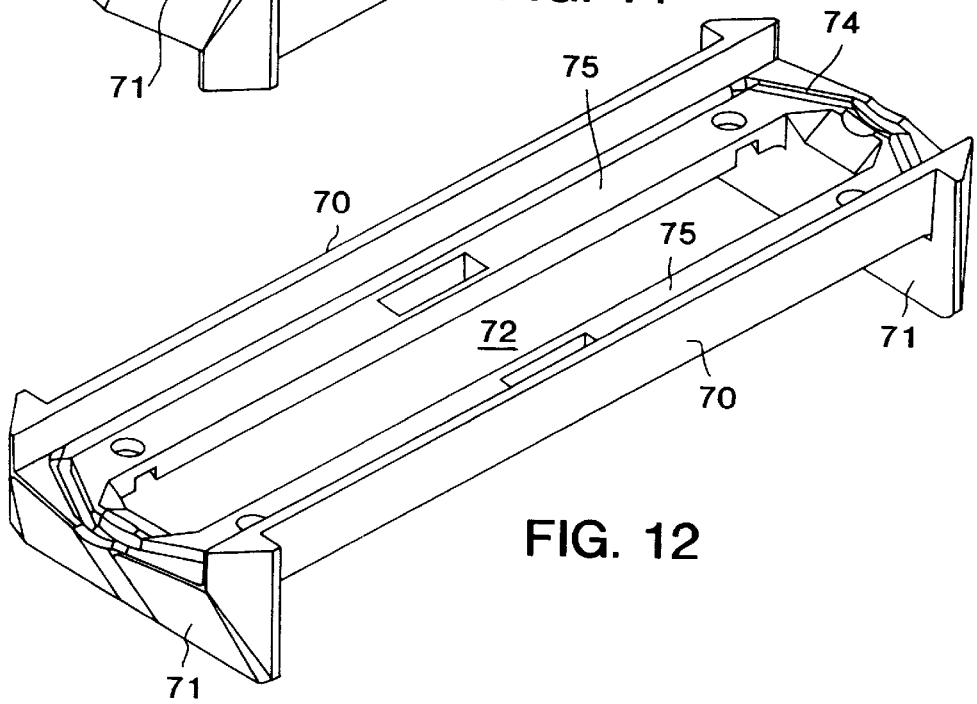
FIG. 12 is a perspective bottom view of the external bearing assembly of FIG. 11.

FIG. 12 is a perspective bottom view of the external bearing assembly of FIG. 11. As depicted, the external bearing assembly 40 can be provided with a sealing member (not shown) that can be inserted in a seal member groove 74 which extends along a peripheral portion of the lower bearing surfaces 75. The use of such an optional sealing member (e.g. o-ring), may be desired to protect the piston assembly and other elements "covered" by the bearing assembly 40, from dust, dirt, fluids, etc. It is noted that the end portions 71 of the external bearing assembly 40 can be tapered outwardly toward the ends of the elongate cylinder body 20 for purposes of clearing the upper surface 31 of the elongate cylinder body 20 as the external bearing assembly 40 moves reciprocally along surface 31.

Figure 13:
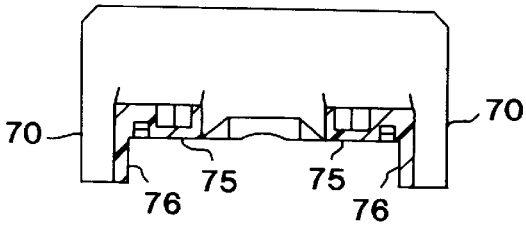
FIG. 13 is a cross-sectional view of the external bearing assembly of FIG. 11.

FIG. 13 is a cross-sectional view of the external bearing assembly. FIG. 13 shows the lower bearing surfaces 75 which are designed to slide along slotted surface 31 of the elongate cylinder body 20 and the side bearing surfaces 76 which are designed to slide along the adjacent side surfaces 66 of the elongate cylinder body 20.

The use of the internal bearing members 36 in the rodless cylinder of the present invention provides constant adjustment of the external bearing assembly 40. That is, even as bearing surfaces 75 wear, the force exerted on the external bearing assembly 40 remains constant due to the manner in which the internal bearing members 36 interact with the inclined portions 58 of the rails 29 and with the inner surface of the cylindrical bore 22.

Figure 14:
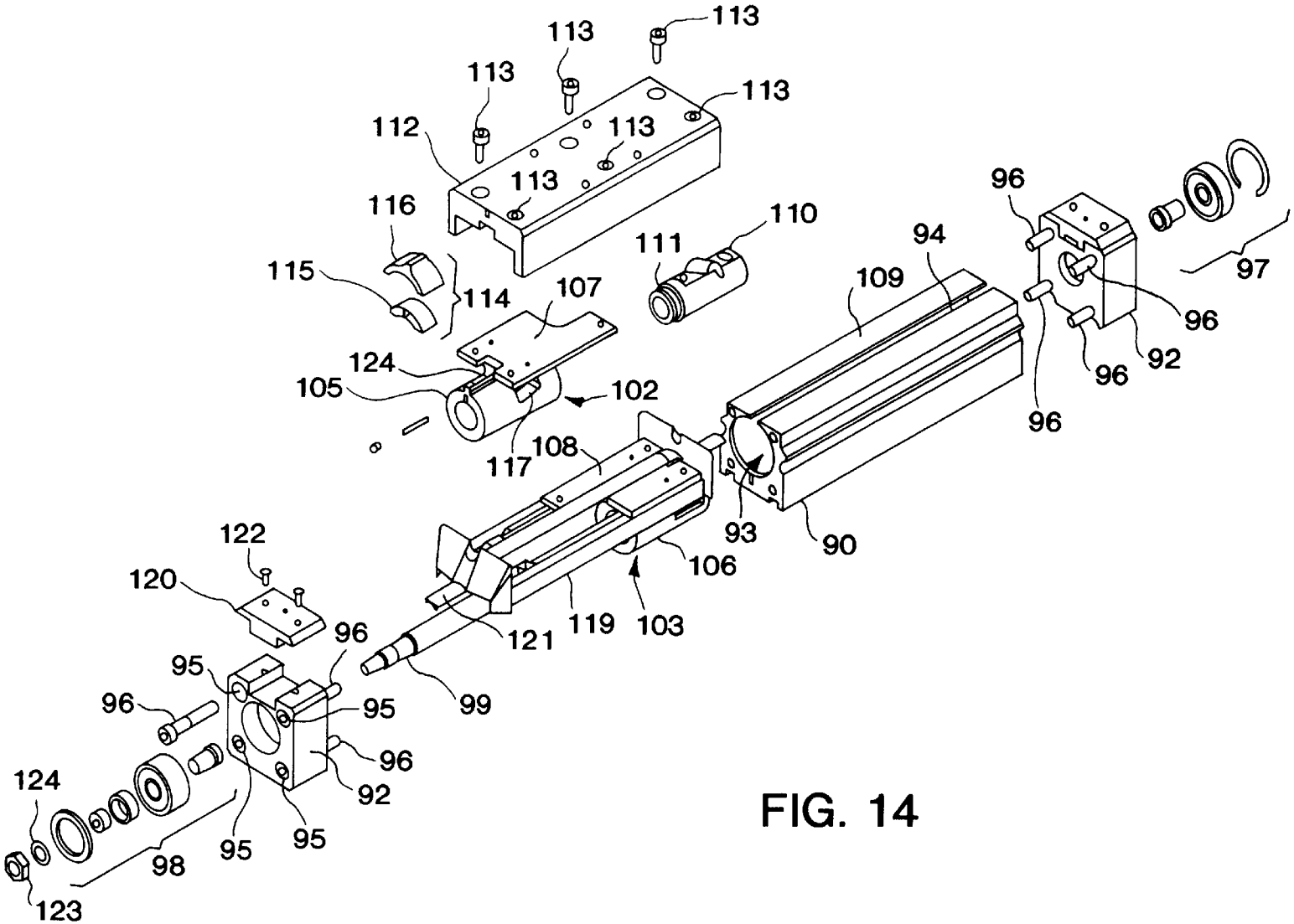
FIG. 14 is an exploded perspective view of a rodless slide assembly according to one embodiment of the present invention.

FIG. 14 is an exploded perspective view of a rodless slide assembly according to one embodiment of the present invention. The rodless slide assembly includes a cylinder assembly which comprises an elongate cylinder body 90 and end cap or head assemblies 92 which seal the elongate cylinder body 90 at opposite ends. The elongate cylinder body 90 includes a cylindrical bore 93 and a slot 94 formed in side wall 109 which can extend along the length thereof. The ends of the elongate cylinder body 90 are provided with threaded bores 95 which receive threaded members, e.g. bolts 96 that are used to secure the head assemblies 92 to the elongate cylinder body 90. The head assemblies 92 are designed to receive bearing assemblies 97 and 98 which secure ends of ball screw 99 that is located within the cylindrical bore 93 when the rodless slide assembly is assembled. One of the bearing assemblies 95 is designed to allow an end of the ball screw 99 to extend therethrough so that a motor, such as a stepper or servo motor can be coupled thereto and used to drive the ball screw 99 in opposite rotational directions.

The rodless slide assembly includes a drive assembly 100 (FIG. 15) which is positioned within cylindrical bore 93 and includes structures which extend through slot 94. The drive assembly 100 includes a transmission bracket 101 which is formed by two half portions 102 and 103 as depicted in the embodiment of FIG. 14 (one located in external bearing assembly 119). When the rodless slide assembly is assembled, the lower portions of the transmission bracket halves 102 and 103 which define cylindrical collars 105 and 106 reside within the cylindrical bore 93 and receive the ball screw 99 therethrough. The upper portion of the transmission bracket half portions 102 and 103 define mounting plates 107 and 108 that are located adjacent the outer wall surface 109 of the elongate cylinder body 90 which surface 109 has the slot 94 formed therein.

A ball nut 110 is provided between the transmission bracket half portions 102 and 103 and is attached to one of the transmission bracket half portions 102 and 103. As indicated in FIG. 14, one end of ball nut 110 is provided with an externally threaded portion 111 that can be received in a corresponding internally threaded portion of transmission bracket half portion 102. The ball nut 110 can be of conventional design and can include a bearing assembly to allow it to freely move along ball screw 99 when ball screw 99 is rotated. The transmission bracket half portions 102 and 103 are coupled together through saddle 112. Saddle 112 can be attached to transmission half portions 102 and 103 by mechanical fasteners such as bolts 113.

Internal bearing assemblies 114 are positioned in the cylindrical collar portions 105 and 106 of the transmission bracket half portions 102 and 103. The internal bearing assemblies 114 include inner bearing members 115 and outer bearing shell members 116 which are located in bearing slots 117 provided in the cylindrical collar portions 105 and 106 of each of the transmission bracket half portions 102 and 103. As discussed below, bearing slots 117 include lower inclined surfaces 118, along which the inner bearing members 115 can slide when they are moved relative to the transmission bracket half portions 102 and 103 in a direction parallel to the axis thereof. The inclined surfaces 118 of the bearing slots 117 can have angles of from 3° to 10° or greater, with an angle of about 7° being particularly suitable for purposes of the present invention. These angles are measured with respect to the central axis of the rodless slide assembly.

FIG. 14 also depicts an external bearing assembly 119 which is designed to be secured between the upper portion of mounting plates 107 and 108 of the transmission bracket 100 and saddle 112 by the threaded members 113. Also shown in FIG. 14 are band clamp plates 120 which can be used to secure the ends of band member 121 in place. The band clamp plates 120 can be secured in position by threaded members 122. As is known, rodless slides do not require internal sealing bands, as do rodless cylinders.

Figure 15:
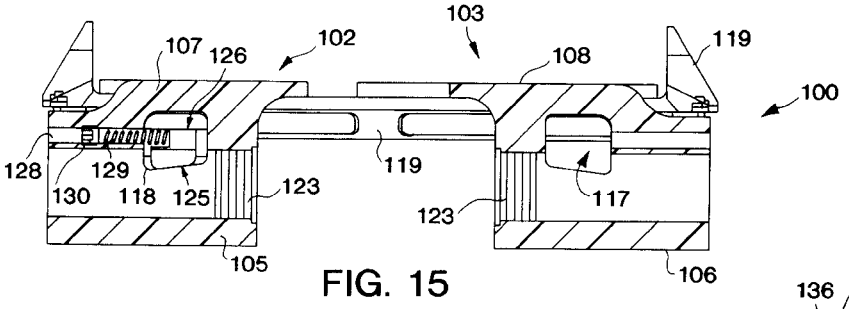
FIG. 15 is a cross-sectional view of a drive assembly which includes spring members that urge the internal bearing members toward the center of the transmission bracket.

FIG. 15 is a cross-sectional view of a drive assembly (absent ball screw 99 and ball nut 110) which includes spring members that urge the internal bearing members toward the center of the transmission bracket. FIG. 15 is a perspective view of a drive assembly according to one embodiment of the present invention. The drive assembly generally identified by reference numeral 100 includes transmission bracket 101 (which comprises two half portions 102 and 103), inner bearing members 115 and outer bearing shell members 116, and external bearing assembly 119. The cylindrical collar portions 105 and 106 of the transmission bracket half portions 102 and 103 are depicted as being axially aligned in FIG. 15, with their upper mounting plates 107 and 108 extending through a slot provided in the external bearing assembly 119 (FIG. 14). As can be seen, the upper mounting plates 107 and 108 provide a coplanar surface to which the saddle 112 (FIG. 14) can be attached as described above.

In the embodiment of the invention depicted in FIG. 15, each of the half portions 102 and 103 of the transmission bracket 101 are identical (with one turned around). Thus, each includes an internally threaded portion 123, to which the ball nut 110 of FIG. 14 can be attached, even though the ball nut 110 need only be attached to one of the half portions 102 or 103 of the transmission bracket 101. As discussed above, when the ball nut 110 is attached to one of the half portions 102 or 103 of the transmission bracket 101 and driven thereby in the elongate cylindrical body 90, the other half portion of the transmission bracket 101 which is not driven will nevertheless be coupled to the driven portion through the saddle 112 which is coupled to the mounting plates 107 and 108 of each of the half portions 102 and 103 of the transmission bracket 101.

As depicted in FIG. 14, each half portion 102 and 103 of the transmission bracket 101 includes a narrow portion 124 which is sized to be received in and extend through slot 94 formed in the elongate cylindrical body 90. These narrow portions 124 extend between the mounting plates 107 and 108 and the cylindrical collar portions 105 and 106 of the half portions 102 and 103 of the transmission bracket 101.

Bearing slots 117 are formed in upper portions of the cylindrical collar portions 105 and 106 of the transmission bracket half portions 102 and 103. The bearing slots 117 have lower surfaces 118 which are sloped or inclined toward the center of the drive assembly 100 as depicted in FIG. 15, and open tops so that the outer bearing shell members 116 can be in contact with the internal surface of the cylindrical bore 93 formed in the elongate cylindrical body 90. Inner bearing members 115 have sloped or angled bottoms 125 are complementary to the lower surfaces 118 of the bearing slots 117, so that the upper most surfaces 126 of the inner bearing members 115 are parallel to the axis of the rodless slide.

As depicted in FIG. 14, the inner bearing members 115 are arcuate structures. The outer bearing shell members 116 are arcuate cylindrical structures which are shaped to be complementary to inner bearing members 115 so that the outer bearing shell members 116 can lay over the inner bearing members 115 as depicted. The outer bearing shell is pushed upward against the internal surface of the cylindrical bore 93 formed in the elongate cylindrical body 90 when the inner bearing members 115 are pushed or urged toward the center of the drive assembly 100 and up the inclined lower surfaces 118 of the bearing slots 117. The forces which are generated as the inner bearing members 115 slide along the inclined lower surfaces 118 of the bearing slots 117 and act between the outer bearing shell members 116, internal surface of the cylindrical bore 93, and external bearing assembly 119 are similar to the forces which are discussed in detail above with reference to FIG. 7. That is, as each of the inner bearing members 115 slides along the lower surfaces 118 of the bearing slots 117 toward the center of the drive assembly 100, it moves up the lower inclined surfaces 118 and presses the overlying outer bearing shell member 116 against the upper inner surface of the cylindrical bore 93. Forces exerted between the outer bearing shell members 116 and the inner surface of the cylindrical bore 93 create a resultant force which pushes the mounting plates 107 and 108 of the transmission bracket 101 downward.

Since the embodiment of the invention directed to a rodless slide does not include pistons as in the case of rodless cylinders, a spring mechanism is provided to urge the inner bearing members 115 toward the center of the drive assembly 100. As depicted in FIGS. 14 and 15, an internally threaded bore 128 is provided in each of the cylindrical collar portions 105 and 106 of the transmission bracket half portions 102 and 103. These internally threaded bores 128 extend into the bearing slots 117 so that a spring element 129 secured therein by a set screw 130 biases the inner bearing members 115 toward the center of the drive assembly 100 as best depicted in FIG. 15.

As best depicted in FIG. 15, the inner bearing members 115 need to have widths (measured in the axial direction of the drive assembly) which are shorter than the corresponding widths of the bearing slots 117 in order to provide room for the inner bearing members 115 to slide along the inclined lower surfaces 118 of the bearing slots 117. The outer bearing shell members 116 can have widths which are substantially equal to the corresponding widths of bearing slots 117. In an alternative embodiment to that depicted in FIG. 15, complementary sloped or inclined surfaces could be provided between the inner bearing members 115 and the outer bearing shell members 116 rather than between the lower surface 118 of the bearing slots 117 and inner bearing members 115.

Figure 16:
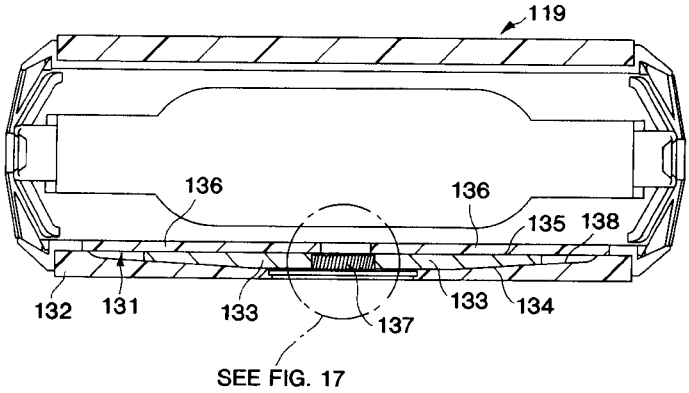
FIG. 16 is a cross-sectional view of an external bearing assembly according to another embodiment of the present invention.

FIG. 16 is a cross-sectional view of an external bearing assembly according to another embodiment of the present invention. The bearing shoe or external bearing assembly 119 depicted in FIG. 16 is substantially similar to that depicted in FIGS. 11–13, with the addition of a gib system. As depicted in FIG. 16, a channel 131 is formed in the inner side walls 132 of the external bearing assembly 119. The outer side edge 138 of the channel 131 tapers toward the center. Gib elements 133 are located in the channel 131. The gib elements 133 have outer sides 134 which are tapered in a complementary fashion with the tapered outer side edge 138 of the channel 131, and inner sides 135 which are non-tapered. Flat bearing elements 136 are provided adjacent the inner sides 135 of the gib elements 133 as depicted. The gib elements 133 are coupled to a spring element 137 which biases or urges the gib elements 133 away from each other. As the gib elements 133 are urged away from each other their inclined outer sides 134 cooperate with the inclined outer side edge 138 of the channel 131 thereby pushing the flat bearing elements 136 inward. When the external bearing assembly 119 of FIG. 16 is coupled to a rodless slide or a rodless cylinder, the gib system will effect a self-adjusting tightening thereof and tightening of a saddle 112 coupled thereto. Although it is only necessary to provide one side of the external bearing assembly with the gib system, both sides could be provided with gib systems if desired. In alternative embodiments, complementary tapered sides could be provided between the gib elements 133 and the bearing elements 136 rather than between the gib elements 133 outer side edges 138 of the channel 131.

Figure 17:
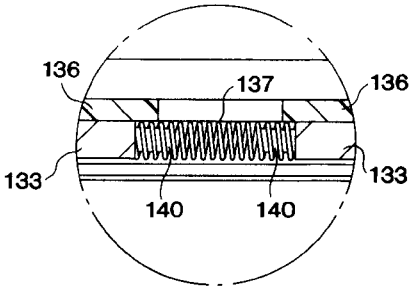
FIG. 17 is an enlarged detail view of a spring arrangement that can be used in the external bearing assembly of FIG. 16.

FIG. 17 is an enlarged detail view of a spring arrangement that can be used in the external bearing assembly of FIG. 16. FIG. 17 depicts the facing ends of the gib elements 133 as having protrusions 140 which are received in opposite ends of a spring element 137. Other arrangements for coupling the gib elements 133 to a spring element 137 are possible, including receiving opposite ends of the spring element 137 in shallow bores formed in the facing ends of the gib elements 133.

It is noted that the features of the present invention are not limited to use in conjunction with cylindrical chambers, cylindrical pistons, cylindrical transmission bracket portions, etc. The features of the present invention could be incorporated into chambers which have other than circular cross-sections, and use pistons, transmission brackets that have cross-sectional shapes which are other than circular. The features of the present invention can be applied to all linear actuators and is not limited to use with rodless cylinders and rodless slides.

Although the present invention has been described with reference to particular means, materials and embodiments, from the foregoing description, one skilled in the art can easily ascertain the essential characteristics of the present invention and various changes and modifications may be made to adapt the various uses and characteristics without departing from the spirit and scope of the present invention as set forth in the following claims.

What is claimed is:

1. A rodless slide which comprises:

a cylinder having opposed ends and a longitudinal slot;

a threaded drive member within the cylinder and extending between the opposed ends; and a drive assembly which comprises:

a transmission bracket having cylindrical portions located in the cylinder, the cylindrical portions including bearing slots formed therein which bearing slots include inclined surfaces; and internal bearing members which are positioned on the inclined surfaces of the bearing slots so as to freely slide thereon.

2. The rodless slide according to claim 1, wherein the internal bearing members comprise inner bearing members and outer bearing shell members.

3. The rodless slide according to claim 2, wherein the inner bearings include inclined lower surfaces.

4. The rodless slide according to claim 3 wherein the outer bearing shell members have opposed parallel sides.

5. The rodless slide according to claim 2, wherein the inner bearing members and the outer bearing shell members have widths measured axially and the widths of the inner bearing members are smaller than the widths of the outer bearing shell members.

6. The rodless slide according to claim 2, further comprising means to urge the inner bearing members along and up the inclined surfaces of the bearing slots.

7. The rodless slide according to claim 6, wherein the means to urge the inner bearing members comprises spring members.

8. The rodless slide according to claim 7, wherein the spring members are located in the cylindrical portions of the transmission bracket.

9. The rodless slide according to claim 8, wherein the transmission bracket is defined by two half portions each of which includes a cylindrical portion.

10. The rodless slide according to claim 9, further comprising a driven member which cooperates with the threaded member for reciprocal movement in the cylinder, the driven member being positioned between the cylindrical portions of the two half portions of the transmission bracket.

11. The rodless slide according to claim 1, wherein the internal bearing members have arcuate shapes.

12. The rodless slide according to claim 1, wherein the transmission bracket includes a mounting plate.

13. The rodless slide according to claim 12, further comprising an external bearing assembly which is coupled to the mounting plate for movement along an outer surface of the cylinder.

14. The rodless slide according to claim 13, wherein the external bearing assembly includes a gib system in an inner side wall thereof maintaining a tight fit between the external bearing and the cylinder.

15. A linear actuator which comprises:

an elongate chamber housing having an axis, a slot formed in a first side thereof, an internal bore, and a threaded drive member which extends through the internal bore;

a transmission bracket which is positioned partially in the internal bore of the elongate chamber and which includes a mounting bracket that extends through the slot and a collar which receives the threaded drive member, the collar including a bearing slot therein; and internal bearing members which are positioned in the bearing slot for exerting a radial force on the mounting bracket.

16. The linear actuator according to claim 15, wherein the internal bearing members comprise an inner bearing member and an outer bearing shell member.

17. The linear actuator according to claim 16, wherein the bearing slot includes an inclined surface and further comprising means to urge the inner bearing member along the inclined surface.

18. A method of coupling a saddle to a linear actuator assembly which comprises:

providing a linear actuator assembly which includes:

an elongate chamber housing having an axis, a longitudinal slot formed in a first side thereof, an internal bore, and a threaded drive member which extends through the internal bore; and a transmission bracket which is positioned partially in the internal bore of the elongate chamber and which includes a mounting bracket that extends through the slot, and a collar which receives the threaded drive member, the collar including a bearing slot therein;

positioning an internal bearing member assembly in the bearing slot;

operably coupling the internal bearing member to the transmission bracket so that radial forces are exerted on the mounting bracket when the internal bearing member moves axially with respect to the transmission bracket; and coupling a saddle to the mounting bracket.

19. An external bearing assembly for a linear actuator which comprises:

a body portion having opposed side walls for straddling a linear actuator; and a gib system provided in at least one of the opposed side walls, the gib system including a pair of tapered gib elements which are biased to move apart from one another.

20. The external bearing assembly according to claim 19, wherein the at least one opposed side wall is provided with a channel having a tapered wall which is complementary tapered with respect to the gib elements and against which the gib elements slide by the biasing force, and at least one bearing element on a side of the gib elements which is an opposed side from the tapered wall.

21. The external bearing assembly according to claim 19, wherein the pair of tapered gib elements are biased by a spring element which is position therebetween.

* * * * *